United States Patent [19]

Lewis

[11] 4,144,366

[45] Mar. 13, 1979

[54] MULTI-COLORED PATTERN BONDED FABRIC

[75] Inventor: Robert D. Lewis, Landisville, Pa.

[73] Assignee: Armstrong Cork Company, Lancaster, Pa.

[21] Appl. No.: 830,699

[22] Filed: Sep. 6, 1977

[51] Int. Cl.[2] ..... D04H 11/00

[52] U.S. Cl. ..... 428/88; 28/109; 28/160; 428/234; 428/300

[58] Field of Search ..... 428/234, 300, 85, 90, 428/88; 156/72, 172, 148; 28/107, 109, 160

[56] References Cited

U.S. PATENT DOCUMENTS 3,755,055 8/1973 Lochner ..... 428/96

*Primary Examiner*—Marion E. McCamish

[57] ABSTRACT

The method and product disclosed herein result in a needle-bonded fabric having a tufted fabric visual. This is accomplished by needling an unconsolidated web consisting of layers of two or more different colored fibers with a needle board having a reduced needle density and wherein the needles are arranged in the needle board in a predetermined pattern. The multi-layer web is processed through a fiber locker containing this reduced needle density board at a higher advance rate per stroke than normal production methods so that the space between the needle punches is greatly increased. The web is transported through the fiber locker in a continuous manner and produces the claimed product. One of the layers of the web is a blend of fibers of widely different fiber deniers and color.

5 Claims, 1 Drawing Figure

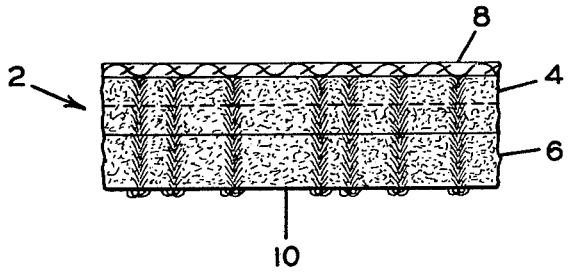
8
2
4
6
10

MULTI-COLORED PATTERN BONDED FABRIC

BACKGROUND OF THE INVENTION

1. Field of the Invention

The invention herein is directed to a needle-bonded fabric and, more particularly, to a needle-bonded carpet product with a tufted fabric visual appearance.

2. Description of the Prior Art

U.S. Pat. No. 3,725,166 is directed to a needle-bonded fabric which is made from two different colored batts. The batts are needle-bonded to force the fibers of the second batt into the fibers of the first batt to attach the fibers together. The fibers of the one batt are not to be forced into the outer surface of the other batt.

U.S. Pat. No. 3,705,064 is directed to a needle-bonded fabric wherein two webs of different color are fastened together by a needling operation. The product is provided with areas containing and areas free of glue, and the presence or absence of the glue affects the needling operation performed on the webs of material.

U.S. Pat. No. 3,613,190 is directed to a needle-bonded fabric which is needled by a fiber locker having its needles arranged in a pattern.

SUMMARY OF THE INVENTION

The invention is directed to a process and the article formed by the process.

The article formed is a multi-layer web having at least three layers. The first layer is a carpet scrim. The second and third layers are layered fibers of different color and possibly different weights. One layer has a blend of fibers of different colors and different weights. The second layer normally has fibers of the same weight, but different in color from the colors of the fibers of the first said layer. The two fiber layers have been needled together with a pattern needle board so that the outer surface of the layer containing the single color fiber contains fibers from the other layer, and the blend of the fibers on this surface provide the surface with a visual effect like that of a tufted carpet. The method for carrying out the invention involves the positioning of a first layer of layered fibers of a certain color and weight. Over this is then positioned the second layered fibers of a different color and different weight and being a blend of fibers of different colors and different weights. The two layers of fibers are needled together. The needles are arranged in a pattern and penetrate through the second layer and through the first layer to the outer surface of the first layer to push the second layer of fibers through the outer surface of the first layer to provide a visual effect on the outer surface of the first layer resulting from the presence of fibers thereon from both layers of fibers.

BRIEF DESCRIPTION OF THE DRAWING

The one FIGURE of the drawing is a cross-sectional view of the product formed by the process herein.

DESCRIPTION OF THE PREFERRED EMBODIMENT

Normal bonded carpet production would normally use a number of webs or layers of layered fiber which may be of a single color or blends of colors. These layers of fiber are moved into a conventional fiber locker, such as disclosed in the above-mentioned prior art patents, wherein there would be a needle board density of about 77.5 needles per square inch. The multi-layer web structure would normally pass through the fiber locker at a rate of about 0.26 inches of web advance per stroke of the needle board. Normally, the needles are arranged in parallel rows in an across machine direction and pass completely through the total web. The fiber lockers are there simply to lock together the webs or fibers by having the barbed needles of the needle board move fibers back and forth between the different layers to lock together the different layers due to fiber locking between the different layers. The product formed from the layers of fibers is normally provided with a scrim to provide the product with increased fiber stability. There is thus normally formed a product which has fibers on either side of the scrim and a plain color or multi-color blend of fibers without any type of pattern thereon. Normally, patterns would be secured in such a product by printing patterns thereon. The product clearly looks like it has a matted fiber surface with a very planar configuration. It produces a product which is inferior in appearance and less aesthetically pleasing than conventional tufted carpet. Through the use of the invention herein, the conventional needle-bonded fabric will be caused to have a very distinct and, even under some circumstances, to take on the visual appearance of a tufted fabric. Thus, the appearance of a higher quality fabric is developed through a less costly manufacturing technique.

Referring to the FIGURE, there is formed a pattern bonded fabric 2 which has a weight of about 14 oz./sq. yd. The fiber of the product is placed in at least two layers 4 and 6. The layer 4 contains the so-called accent shades, which will be multi-colored fibers of different deniers. The layer 4 actually could be more than one layer. The layer 6 may be a single color or blend of various colors of fibers being of different color and different denier from that of layer 4. The product is also provided with a conventional scrim 8.

In one preferred form of the invention, the layer 4 is made from a 50/50% blend of 7 denier polypropylene yarn of one color and 18 denier polypropylene yarn of another color to form a web that is 3.5 oz./sq. yd. Layer 6 is formed from 18 denier polypropylene yarn which is dyed a third color. This web is 10.5 oz./sq. yd. These two webs are combined with a woven polypropylene scrim which is 2.7 oz./sq. yd. in weight. The scrm is locked to the layers 4 and 6 by a conventional fiber locking process. Due to the method and apparatus of U.S. application Ser. No. 796,826, entitled "Pattern Bonded Fiber," fibers from the web 4 are driven to the outer surface 10 of the web 6 and appear on that surface due to the fact that the fibers of web 4 are of a different color and are needled by needles which are arranged in a pattern rather than as a uniform array. Fibers from web 4 provide an accent color to the fibers on the surface 10 of web 6, which constitute the background color. The pattern of the fibers from layer 4 exist on the surface 10 of layer 6 and provide the surface 10 with a distinct pattern which causes the product to provide the visual appearance of being a tufted carpet. The use of a blend of fibers of different deniers makes it possible to obtain a more uniform fiber distribution and reduced variation in fiber density while maintaining distinct color separation. Normally, due to the mechanical action of the needles during consolidation of the fiber layers, a greater amount of fiber from the last applied accent layer is punched through the background layer resulting in an uneven distribution of the accent colors in a two color accent fabric. Also the amount of accent fiber, which is punched through the background layer, is dependent on the fiber density in the accent fiber layer. The use of fiber blends of different deniers overcomes the above problems. The surface of the background batt, which will be one color, will now have thereon fibers of the two other colors which are a part of the accent batt. The fibers need not be blended in only a 50/50 relationship, but they could also be blended in a 75/25 or an 80/20, etc., relationship. The relationship would be a weight relationship of the different materials which would be different deniers and different colors.

Thus it can be seen that a needle pattern bonded fiber carpet can be formed having a multi-layer web with a scrim 8, a second layer 4, and a first layer 6. The first layer 6 has a surface 10 which forms the face fiber portion of a carpet. The layers have been needle bonded together to lock the three layers together and, more particularly, the first and second layers have been needled with needles arranged in a pattern to needle the fibers of the second layer into the outer surface of the first layer to provide a pattern of the first and second layer fibers on the face surface of the carpet, which is the surface 10, the outer surface of layer 6.

The disclosure of U.S. patent application Ser. No. 796,826 is incorporated herein, since that application fully discloses the apparatus and the process for bonding the layers 4, 6, and 8 together with the pattern arrangement of needles. The pattern arrangements and needles of that application are utilized herein, and the material is processed herein in the same manner as that disclosed in that application. The unique feature of this application over that of the other application is that the accent layer herein is made up of a blend of fibers of different denier and color so as to secure better visual effects.

In another embodiment of the invention, the layer 4 is actually made from two separate layers, a first accent layer and a second accent layer. The first accent layer will be a blend of 7 denier polypropylene fibers and 18 denier polypropylene fibers, the fibers of the different deniers being of different colors and the web weighing 3.5 oz./sq. yd. The second accent layer will be a blend of 7 denier and 18 denier polypropylene fibers of a third and fourth color. Finally, layer 6, the background layer, will be made from 18 denier polypropylene fibers of a fifth color, and it will weigh 7 oz./sq. yd. Conventional scrim is used, and the scrim is locked to layers 4 and 6 by the conventional fiber locking process and the unique pattern bonding process set forth in the above-mentioned application. Using this particular arrangement and blending it together allows the processing of a four color accent fiber appearance on a background layer of a fifth color. The fibers being of different denier, a more distinct color separation is secured and a blended monochromatic color accent is avoided. With the above-described accent layer configuration, one can secure a very distinctive four color accent effect. As was indicated above, the blends of fibers can be of a different relationship, and the above example was based upon a 50/50% blend of the different fibers in the two accents layers.

What is claimed is:

1. A needle pattern bonded fiber carpet comprising:

(a) a multi-layer web having at least three layers, (b) the first layer being a layer of layered fibers of a certain color and denier, (c) the second layer being at least a single layer of blended fibers of different color and denier from each other in the second layer, (d) the last layer being a carpet scrim layer, (e) said three layers being positioned with said second layer being positioned over said scrim layer, and then said first layer being positioned over said second layer, with said outer surface of said first layer forming the carpet face surface, and (f) said layers being needle-bonded to lock together the three layers, said first and second layers being needled with needles arranged in a pattern to needle the fibers of the second layer, which is a blend of different fibers, into the outer surface of the first layer to provide a pattern of first and second layer fibers on the face surface of the carpet.

2. The needle pattern bonded fiber carpet of claim 1 wherein the second layer is a blend of fibers of two different colors and two different deniers, and said colors are different from the colors of the first layer.

3. A needle pattern bonded fiber carpet as set forth in claim 1 wherein the second layer is composed of two separate layers, each layer being a blend of fibers of different denier and color from each other and from the fibers of the other layer, which forms the first layer, whereby the second layer is actually formed as two separate layers with fibers of four separate colors and at least two different deniers per layer.

4. A method of forming a needle pattern bonded fiber carpet comprising the steps of:

(a) positioning a first layer of a layered fiber of a certain color and denier, (b) then positioning over said first layer at least a second layer of layered fibers of different color and denier from that of the first layer, and said second layer being a blend of fibers of two colors and two deniers, (c) needling said layers of fibers to each other while the fiber layers are moving, said needling being carried out partly by needles arranged in a pattern, and (d) the fibers of the second layer being needled into the adjacent surface of and through the first layer to the outer surface of the first layer to provide a pattern of first and second fibers on the outer surface of the first layer.

5. The method of forming a needle pattern bonded fiber carpet as set forth in claim 4 wherein a scrim is added to the outer surface of the second layer, and the tufts of the first and second fiber layers on the outer surface of the first layer are consolidated back into the face surface of the first layer.

* * * * *